US006146097A

United States Patent [19]

Bradt

[11] Patent Number: 6,146,097

[45] Date of Patent: Nov. 14, 2000

[54] FAN BLADE ASSEMBLY FOR USE WITH A CEILING FAN DRIVE UNIT

[76] Inventor: Gordon E. Bradt, Rte. 2, Box 470, Eureka Springs, Ark. 72632

[21] Appl. No.: 09/152,314

[22] Filed: Sep. 14, 1998

[51] Int. Cl.[7] ..... F04D 29/00

[52] U.S. Cl. ..... 416/5; 416/169 R; 416/225; 416/226; 416/223

[58] Field of Search ..... 416/5, 61, 120, 416/225, 226, 169 R, 229 R, 124, 231 R, 233; 362/96

[56] References Cited

U.S. PATENT DOCUMENTS

| | | | |
|---|---|---|---|
| D. 321,935 | 11/1991 | Ignon . | |
| D. 336,513 | 6/1993 | Junkin et al. . | |
| D. 341,419 | 11/1993 | Taylor, III . | |
| 2,918,977 | 12/1959 | Fedan et al. | 416/233 |
| 4,046,489 | 9/1977 | Fairchild et al. . | |
| 4,093,402 | 6/1978 | Van Holten . | |
| 4,222,710 | 9/1980 | Katagiri et al. . | |
| 4,422,824 | 12/1983 | Eisenhandt, Jr. . | |
| 4,515,538 | 5/1985 | Shih . | |
| 4,662,823 | 5/1987 | Cooke . | |
| 4,693,673 | 9/1987 | Nee . | |
| 4,892,460 | 1/1990 | Volk . | |
| 5,028,206 | 7/1991 | Kendregan et al. . | |
| 5,110,261 | 5/1992 | Junkin . | |
| 5,193,983 | 3/1993 | Shyu . | |
| 5,195,870 | 3/1993 | Liu . | |
| 5,230,850 | 7/1993 | Lewis . | |
| 5,244,349 | 9/1993 | Wang . | |
| 5,462,407 | 10/1995 | Calvo . | |
| 5,554,006 | 9/1996 | Liao . | |
| 5,586,867 | 12/1996 | Mehlos | 416/5 |
| 5,658,129 | 8/1997 | Pearce . | |

*Primary Examiner*—Edward K. Look
*Assistant Examiner*—Liam McDowell
*Attorney, Agent, or Firm*—Boyd D. Cox

[57] ABSTRACT

A fan blade assembly for a ceiling fan has lightweight, oversized blades formed by a support frame with a blade covering material stretched over the frame. A lighting fixture attached to the support frame rotates with the fan blades. The fan blades are contoured to provide airfoil characteristics having an optimal compromise to maximize air circulation when rotating in a clockwise and counterclockwise direction. In a ceiling fan, the fan blade assembly can be used singluarly or used in combination with conventional fan blades on the ceiling fan.

24 Claims, 3 Drawing Sheets

FAN BLADE ASSEMBLY FOR USE WITH A CEILING FAN DRIVE UNIT

BACKGROUND

The present invention is a fan blade assembly characterized by strong, lightweight blades with contoured surfaces having airfoil characteristics which provide an optimal compromise to effectively circulate air in both a clockwise and a counterclockwise direction at relatively low rotational velocities. The fan blade assembly can include a lighting system having an illuminant housed within the fan blade. The fan blade assembly can be used singularly with a fan drive unit for a ceiling fan, or alternately, the assembly can be used in combination with a conventional ceiling fan and its existing fan blades.

Ceiling fans are used to circulate ambient air in a room or area. They are particularly useful in assisting heating and cooling systems. By increasing the air circulation, a ceiling fan can lower the amount of electrical power required to run heating and cooling systems.

The rotational speed, pitch, and diameter of the fan blades are the three major factors for consideration in moving air. Larger diameter blades which can move more air at a lower velocity are the most desirable for comfort and efficiency. Conventional ceiling fan blades have been limited to about five feet in diameter and therefore, must rotate at speeds up to 300 RPM (revolutions per minute) in order to move adequate amounts of air. The higher fan speeds can create uncomfortable drafts, as well as undesirable noise. If conventional blades are simply made larger, the weight of the blades proportionally increases and can reduce the efficiency of the motor. However, by increasing the diameter of the blades by 50%, the amount of air moved at the same rotational speed is more than doubled. Therefore, to move the same amount of air the fan blade speed could be cut by more than one half.

Conventional ceiling fan blades are generally planar with a two dimensional form. They are typically rotated in two directions, pushing the air downward for cooling circulation and upward for heating circulation. The two dimensional blades do not optimize air flow for bi-directional rotation which generally requires the more effective airflow when pushing downward during circulation for cooling, as opposed to when pushing upwardly to gently dissipate the hot air layering for heating circulation.

The present invention provides a fan assembly with fan blades that have a higher strength to weight ratio than conventional fan blades which enables the blade diameter to be larger than the conventional five feet, while maintaining the strength, weight, and integrity of the blade. With a larger diameter, the fan blade assembly of the present invention can move the same volume of air at a lower speed, that a conventional blade will move at a higher speed. Therefore, due to the efficiency of using a lower fan speed, the fan blade assembly of the present invention provides adequate air circulation at a reduced power requirement.

In addition, the shape and contour of the blades of the present invention can more effectively optimize circulation of the ambient air at lower velocities in both a clockwise and counterclockwise direction, wherein the downward thrust of circulating air is greater than the upward pulling. By using the present fan blade assembly on a ceiling fan, power consumption is minimized, the operating noise level is reduced and the air is circulated at an optimum speed in both an upward and downward direction for the user's comfort.

SUMMARY

The fan blade assembly of the present invention comprises a plurality of fan blades constructed from a series of transverse ribs and longitudinally extending spars which are covered in a transparent or translucent material. The blades have airfoil characteristics which provide an optimal compromise for effectively circulating the ambient air when the blades rotate both in a clockwise and counterclockwise direction. The fan blade assembly can include a lighting assembly with a light fixture or illuminant housed within the fan blade for illuminating the surrounding environment.

It is an object of the present invention to provide a strong, lightweight fan blade with airfoil characteristics which provide an optimal compromise for effectively circulating air when the blades are rotating in either a clockwise or a counterclockwise direction.

It is a further object of the present invention to provide a fan blade assembly that has an illumination source housed within the fan blades wherein the illumination source rotates with the fan blades.

It is a further object of the present invention to provide a fan blade that can be used effectively with a direct drive motor at velocities from about 50 to 100 RPM's while moving sufficient air to ensure comfort for surrounding occupants.

It is a further object of the present invention to provide a fan blade assembly with oversized fan blades having a diameter of approximately seven feet.

It is a further object of the present invention to provide a fan blade assembly with oversized, lightweight blades that can be fitted on a conventional ceiling fan and used in combination with the existing fan blades on the ceiling fan to circulate air.

It is a further object of the present invention to provide a fan blade assembly having a diameter larger than a conventional fan blade diameter of five feet.

It is a further object of the present invention to provide a fan blade that is contoured to create a larger downward thrust of air than the upward pull of air.

It is a further object of the present invention to provide a fan blade assembly for a ceiling fan that provides effective air circulation and illumination, simultaneously.

The fan blades of the present invention have a strength to weight ratio that is substantially greater than those conventional fan blades which are generally solid, planar forms. Therefore, the fan blades of the present invention can be oversized and installed on an existing ceiling fan in lieu of the smaller sized, conventional fan blades. When rotated at lower RPM's these larger fan blades circulate at least the same amount of air as smaller conventional fan blades operating at substantially higher RPM's. The lower rotational speed creates less noise and the slower movement of air is more comfortable to the occupants of the room. In addition, the inherent lightness and strength of the fan blades, enable the blades to be contoured and thereby improve the blade's airfoil characteristics. The fan blade assembly of the present invention provides an optimal compromise for air flow in both downward and upward directions, where it is desirable that the assembly create a larger thrust of downward air flow than upward air flow.

DETAILED DESCRIPTION

The diameter of the fan blades and fan blade assembly refers to the diameter of the circle defined by the outermost points of the fan blades when the assembly is rotating.

Figure 1:
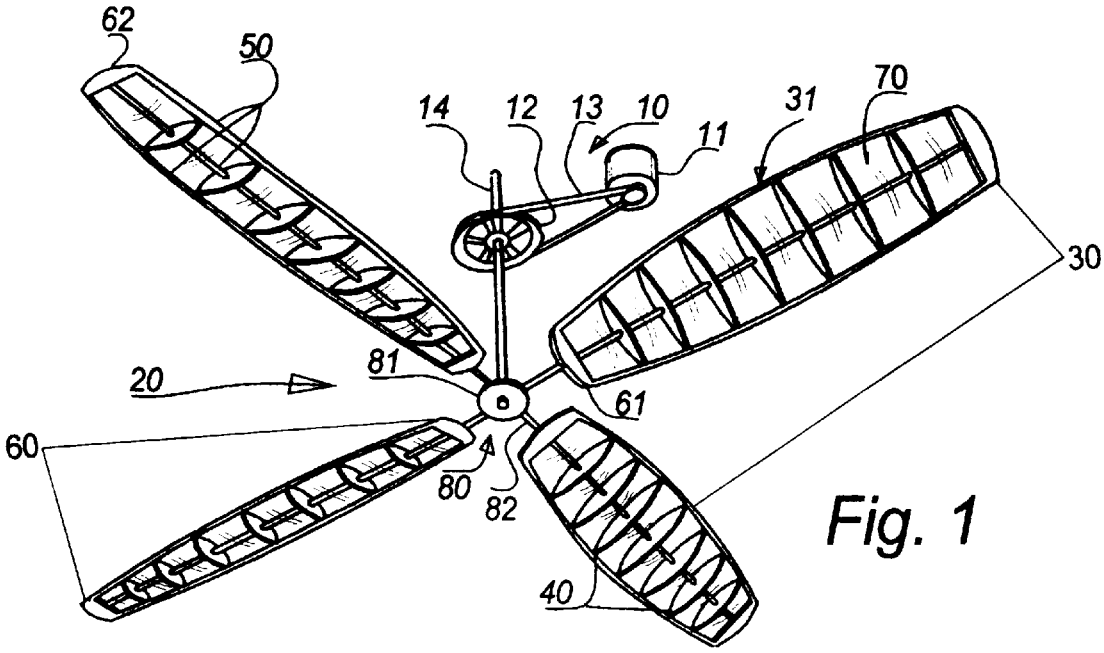
FIG. 1 is a bottom perspective view of the fan blade assembly of the present invention shown in combination with a direct drive unit of a ceiling fan.

Referring to FIG. 1, the fan blade assembly (20) of the present invention is shown with a ceiling fan motorized drive unit (10).

The fan blade assembly (20) includes a plurality of fan blades (30) and a blade hub assembly (80). Each fan blade (30) is made up of a support frame (31) comprising series of ribs (40), a pair of blade end pieces (60), and a plurality of spars (50) each having a longitudinal axis. Each fan blade (30) also includes a blade covering material (70). The end pieces (60) of the fan blade (30) include a proximal end piece (61) and a distal end piece (62). The blade hub assembly (80) is formed by a central hub (81) with blade stems (82).

Figure 2:
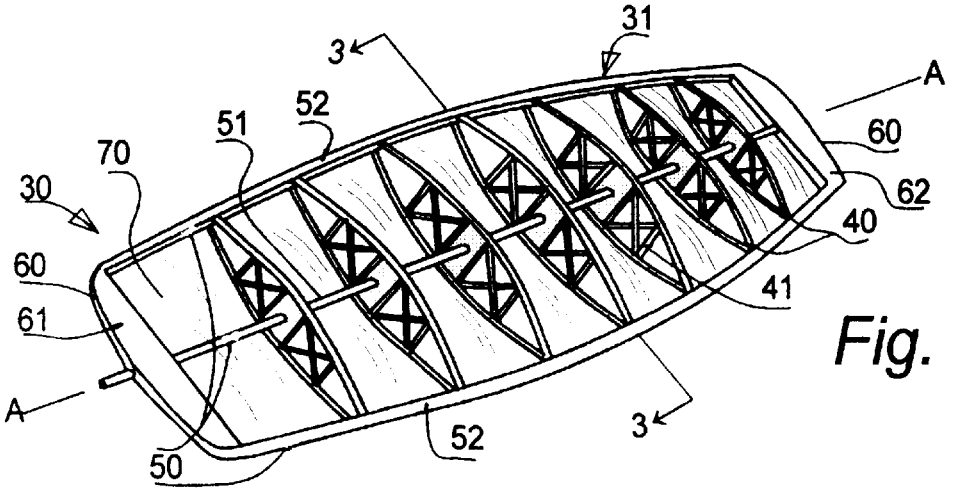
FIG. 2 is a top perspective view of a first embodiment of the fan blade of the present invention for use in the fan blade assembly of FIG. 1.
Figure 3:
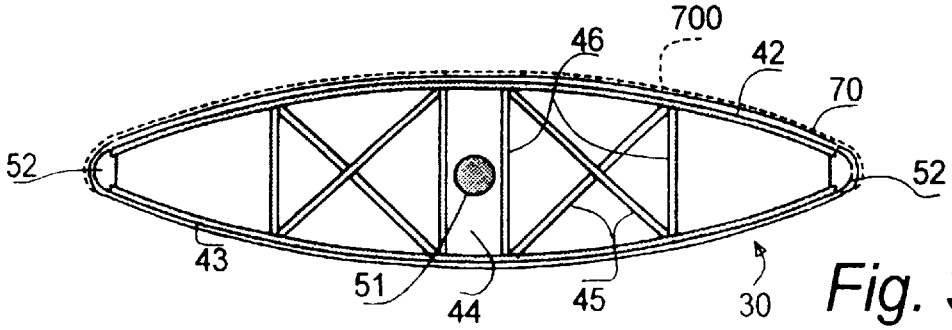
FIG. 3 is a cross sectional view of the fan blade of the first embodiment taken at line 3—3 in FIG. 2.

In a first preferred embodiment of the fan blade (40), as shown in FIGS. 2 and 3, the ribs (40) are comprised by a pair of internal bridge trusses (41), an upper bow member (42), a lower bow member (43) and a rib plate (44). The spars (50) include a center radial spar (51) and radial edge spars (52). Each internal bridge truss (41) is formed by a pair of crossed members (45) flanked by side struts (46).

Figure 8:
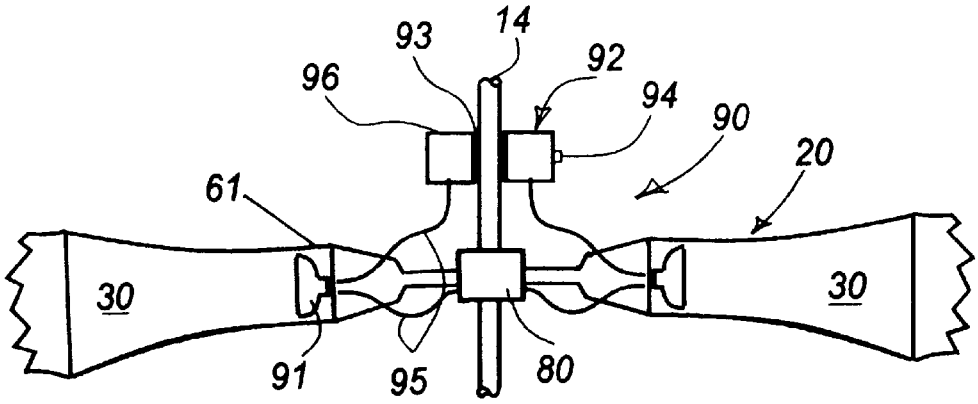
FIG. 8 is partial cross sectional schematic view taken through the blade hub assembly showing the fan blade assembly with the lighting assembly installed thereon.

In addition, a lighting assembly (90) as depicted in FIG. 8 can be included with the fan blade assembly (20). The lighting assembly (90) has at least one light fixture (91) and a pivotal electrical hookup (92). Preferably, the light fixture (91) requires a low voltage. The pivotal electrical hookup (92) includes a contact ring (96) having an insulating sleeve (93) with a brush and wire assembly (94) and connecting wires (95). Preferably, the light fixture (91) is a low voltage fixture.

The fan blades (30) are elongated having a length that is greater than the width. In the first preferred embodiment shown in FIG. 3, the cross section of the fan blade (30) varies in thickness across the width of the blade (30). The thickness is maximum at a central region of the blade (30) near the rib plate (44) and decreases towards the radial edge spars (52) where the thickness is minimum.

The ribs (40), spars (50) and blade end pieces (60) shown in FIG. 1 of the blades are preferably made of lightweight, durable materials including aluminum, wood and plastic. However, other materials with similar characteristics could be used as long as they are lightweight and durable.

The blade covering material (70) is, preferably, a thin, transparent or translucent material. Optionally, it can be an opaque material or a combination of any two or three transparent, translucent and opaque materials.

Referring to FIG. 1, the ribs (40), spars (50) and end pieces (60) form the support frame (31) of the fan blades (30). The support frame (31) defines the overall shape and contour of each fan blade (30). The blade covering material (70) stretches over the support infrastructure to provide a surface for forcing movement of the air thereby creating airflow as the blades (30) rotate.

The blade hub assembly (80) supports the fan blades (30) on a drive unit (10) which rotates the fan blade assembly (20). The drive unit (10) is preferably motorized and includes a fan motor (11), a drive shaft (14), and a drive pulley (12). A belt (13) extends between the drive pulley (12) and the fan motor (11) and further transfers rotational torque from the fan motor (11) to the drive shaft (14), thereby rotating the fan blade assembly (20). The fan blades (30) push the air as it moves across the surfaces of the rotating blades (30), resulting in circulation of the ambient air.

Referring to FIG. 8, the lighting assembly (90) provides illumination to surrounding areas. Electrical power is provided to the light fixture (91) through the pivotal electrical hook up (92). The contact ring (96) carries a positive current. Acting as a ground, the drive shaft (14) carries a negative current and is insulated from the contact ring (96) by an insulating sleeve (93). As the drive shaft (14) and fan blades (30) rotate, the brush and wire assembly (94) transfers the electrical current from a non-moving electrical source to the rotating contact ring (96). The current is relayed from the contact ring (96) to the light fixture (91) through connecting wires (95). Although a specific pivotal electrical hookup is shown herein, any suitable pivotal electrical hookup could be used instead.

As shown in FIG. 1, the central hub (81) of the fan blade assembly (20) is affixed to the drive shaft (14) when used with a motorized drive unit (10). The blade stems (82) are attached to and radiate outwardly from the central hub (81). Each blade stem (82) supports a fan blade (30). Being coextensive with the blade stems (82), the fan blades (30) also extend radially from the blade hub assembly (81).

Regarding the first preferred embodiment of the fan blade (30) shown in FIG. 2, the radial edge spars (52) are positioned respectively on each side of the center radial spar (51). The center radial spar (51) and the radial edge spars (52) are each attached at respective ends to the proximal end piece (61). The respective opposite ends of the center radial spar (51) and the radial edge spars (52) are attached to the distal end piece (62) of each respective fan blade (30).

The ribs (40) are spaced at intervals along the length of the spars (51, 52) with each rib (40) extending in a plane that intersects the center radial spar (51) and the radial edge spars (52). The spars (51, 52) are held in spaced relationship to each other by the ribs (40) and the blade end pieces (60).

In the first preferred embodiment of FIGS. 2 and 3, the upper (42) and lower (43) bow members define the boundaries of a respective upper and lower fan blade surface. The rib plate (44) is flanked by the internal bridge trusses (41). Both the rib plate (44) and the trusses (41) extend from the upper bow member (42) to the lower bow member (43). Extending through the rib plate (44) is the center radial spar (51). The bow members (42, 43), the rib plate (44), and the internal bridge trusses (41) of each rib (40) are generally positioned in a single plane, each of which intersects all of the spars (51, 52).

The blade covering material (70) is stretched over the ribs (40), spars (50), and end pieces (60), thereby forming an outer surface over the support frame (31). The blade covering material (70) can cover the entire support frame (31) of the fan blade (30) or alternately, the material (700) can cover only a portion of the fan blade (30) as shown schematically in dotted lines in FIGS. 3, 5 and 7. For example, the top side of the support frame (31) can be covered leaving the lower side open for air to flow through the support frame (31) of the fan blade (30).

With the lighting assembly (90) used in combination with the fan blade assembly (20), the light fixture (91) is attached to the proximal end piece (61) of the fan blade (30) as shown in FIG. 8. The light fixture (91) is positioned within the boundaries of the fan blade's support frame (31). When the blade (30) is covered entirely, the light fixture (91) is contained within the blade covering material (70). The number of light fixtures (91) can vary as desired, however it is preferable that no more than one light fixture (91) per fan blade (30) be used.

The pivotal electrical hookup (92) provides electrical power to the light fixtures (91), while enabling the light fixtures (91) to rotate along with the fan blades (30). The brush and wire assembly (94) is mounted on the contact ring and is further connected to the power source. The contact ring (96) is mounted on the drive shaft (14), while the insulating sleeve (93) is disposed between the positively charged contact ring (96) and the negatively charged drive shaft (14). Extending between the contact ring (96) and the light fixtures (91) are respective connecting wires (95).

The diameter of the fan blade assembly (20) can be larger than the conventional ceiling fan diameters which are typically about five feet. Due to the increased strength to weight ratio of the fan blades (30) of the present invention, the blades (30) are preferably about seven feet in diameter which is longer than the diameter of conventional sized blades and yet approximately the same overall weight of conventional fan blade assemblies.

The ribs (40) can vary in size within each fan blade (30) as shown in FIG. 1. Preferably, the ribs (40) nearest the center of the blade (30) are the largest in size with the ribs incrementally decreasing in size extending toward the proximal (61) and distal (62) end pieces. Although it is preferred that the rib sizes vary, the variation in size may be insubstantial or eliminated, if desired.

Preferably, the fan blade assembly (20) can be used as a ceiling fan. Ceiling fans are generally suspended from an overhead surface such as a ceiling or support beam. The fan blade assembly (20) of the present invention can be mounted on a lower end of the drive shaft (14) beneath the rest of the drive unit (10) as shown in FIG. 1.

The ceiling fan (1) provides air circulation for the surrounding room or area. When the fan motor (11) is activated, the belt (13) rotates the drive pulley (12), which in turn rotates the drive shaft (14). As the drive shaft (14) rotates, the attached fan blade assembly (20) rotates. The fan blades (30) create a thrust on the air passing over the surface of the blades (30), thereby circulating the air. The fan blade assembly (20) can be rotated in one direction to create a downward thrust on the air or the assembly (20) can be rotated in the opposite direction to create an upward lift on the air. The shape and contour of the blades (30) provide a greater thrust on the air when it is rotating in one direction than when rotating in the opposite direction. Preferably, the greater thrust occurs in the downward direction when the fan blade assembly (20) is installed as a ceiling fan.

Figure 4:
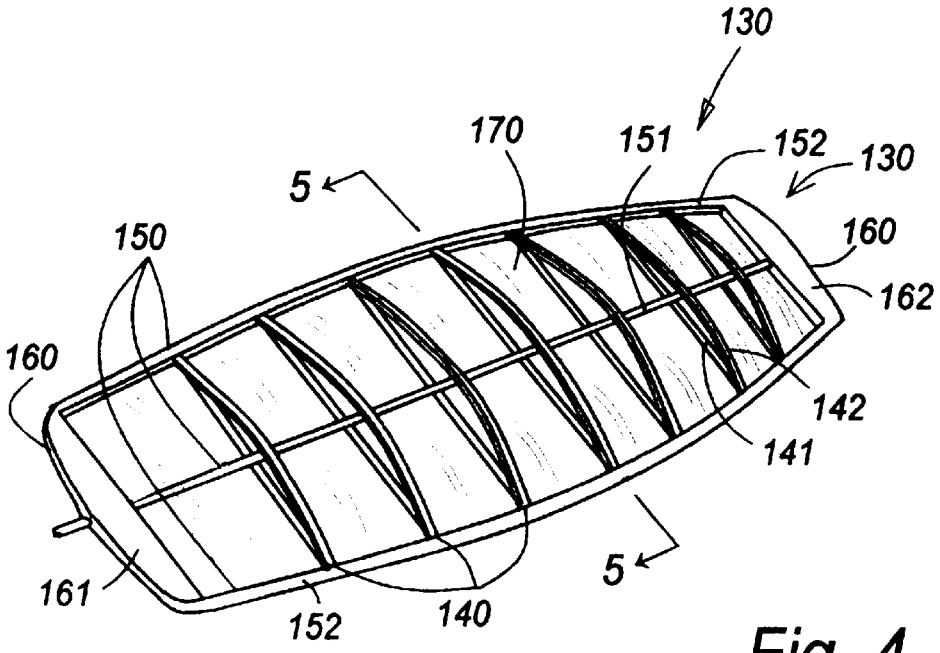
FIG. 4 is a top perspective view of a second embodiment of the fan blade of the present invention for use in the fan blade assembly of FIG. 1.
Figure 5:
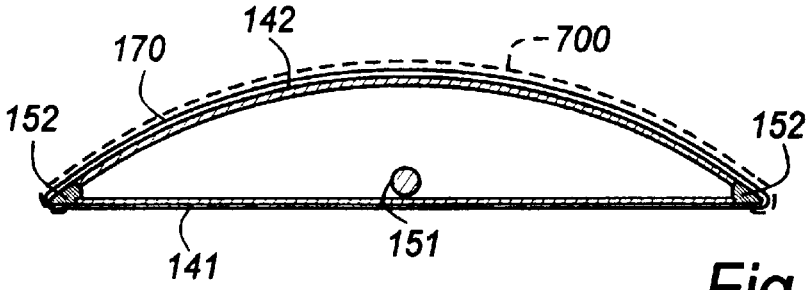
FIG. 5 is a cross sectional view of the fan blade of the second embodiment taken at line 5—5 in FIG. 4.

A second preferred embodiment of the fan blade (130) for use in the fan blade assembly (20) of the present invention is shown in FIGS. 4 and 5. The fan blade (130) includes longitudinally extending spars (150) having blade end pieces (160) positioned at the ends of the spars (150) and a plurality of ribs (140) positioned along the longitudinal axis of the spars (150).

Each of the ribs (140) includes a lower tensioned member (141) and an upper bow member (142). The upper bow member (142) is prestressed and holds the lower member (141) in tension. The spars (150) comprise a center radial spar (151) and a pair of radial edge spars (152), while the blade end pieces (160) include a proximal end piece (161) and a distal end piece (162). The center radial spar (151) is adjacent to the lower member (141) of each of the ribs (140). The blade covering material (170) covers the ribs (140), the spars (150) and the end pieces (160) to define the outer surface of the fan blade (130). Alternately, the material (700) may cover only one side of the blade (130) as shown by the dotted lines in FIG. 5.

Figure 6:
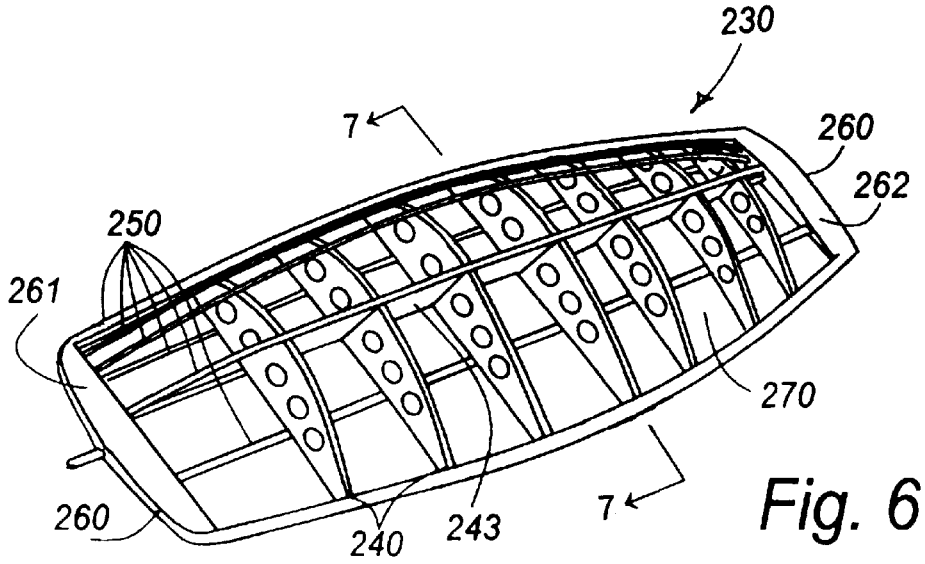
FIG. 6 is a top perspective view of a third embodiment of the fan blade of the present invention for use in the fan blade assembly shown in FIG. 1.
Figure 7:
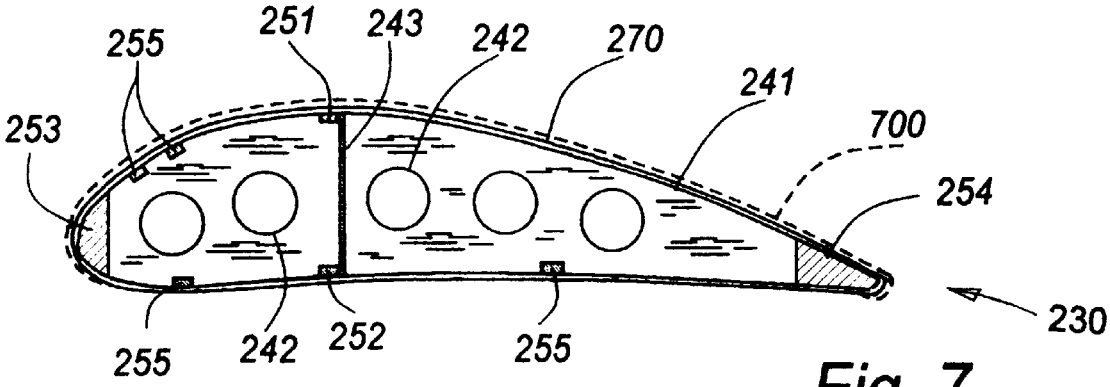
FIG. 7 is a cross sectional view of the third embodiment of the fan blade taken at line 7—7 in FIG. 6.

FIGS. 6 and 7 show a third preferred embodiment of the fan blade (230) which can be used on the fan blade assemby (20) of the present invention. The fan blade (230) comprises a plurality of spars (250), a plurality of ribs (240), and a pair of blade end pieces (260). The plurality of spars (250) include an upper center radial spar (251), a lower center radial spar (252), a first edge radial spar (253) and a second edge radial spar (254), and a plurality of auxiliary spars (255). The spars (250) extend between the blade end pieces (260) which include a proximal end piece (261) and a distal end piece (262).

In the third preferred embodiment, the ribs (240) of the fan blades (230) are formed by a rib plate (241) and a radial reinforcing plate (243). The rib plate (241) is bisected by the radial reinforcing plate (243) which extends in a plane that is generally transverse to the rib plate (241). The radial reinforcing plate (243) adjoins the rib plate (241) adjacent to the upper (251) and lower (252) center radial spars (251, 252).

Apertures (242) are formed in the rib plate (241). The apertures (242) decrease the weight of the rib (240) and the overall weight of the fan blade (230), without compromising the structural integrity of the fan blade (230). The blade covering material (270) is stretched to cover the support infrastructure of each fan blade (230). The blade covering material (270) can cover all of the fan blade (230) as shown by the solid line, or only a portion of the fan blade (230) as shown by the dotted lines in FIG. 7.

In the third preferred embodiment, the position of the first (253) and second (254) edge radial spars marks the width of the respective fan blades (230), while the end pieces (260) mark the length of the respective fan blade. The auxiliary spars (255) extend along the length of the fan blade (230) and are preferably attached to the top and bottom edges of each respective rib (240).

Figure 9:
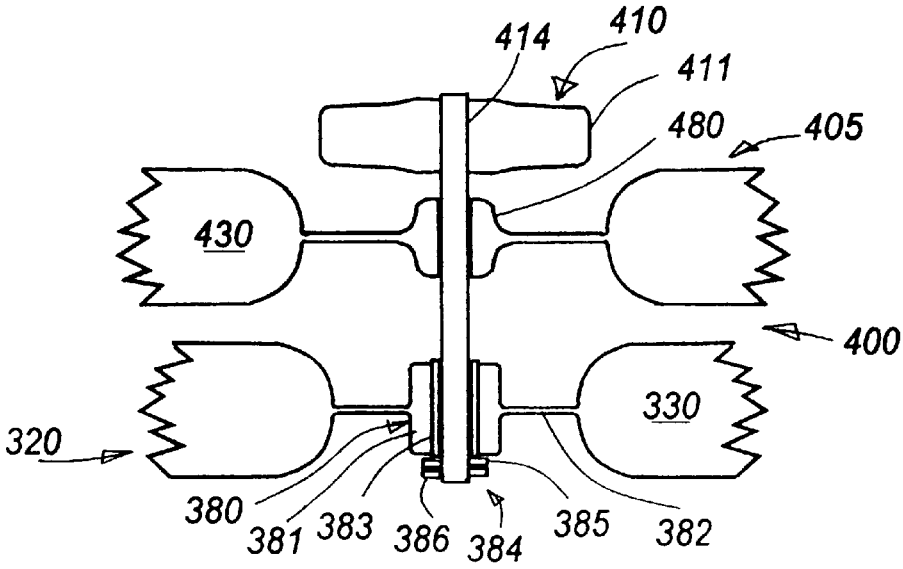
FIG. 9 is a partial cross sectional schematic view of an alternate embodiment of the fan assembly unit used in combination with a conventional ceiling fan.

FIG. 9 shows an alternate embodiment of the fan blade assembly (320) of the present invention. The alternate embodiment of the assembly (320) can be installed on a conventional ceiling fan unit (400) along with the existing fan blades (430) of the fan unit (400). The conventional ceiling fan unit (400) includes a drive unit (410) having a fan motor (411) and a drive shaft (414). The conventional fan blade assembly (405) has fan blades (430) which are attached to the drive shaft (414) by a blade hub assembly (480).

The fan blade assembly (320) of the present invention includes a blade hub assembly (380) that comprises a slip clutch hub (381) having a plurality of radially extending blade stems (382), a bushing (383) and a hub support (384). The hub support (384) includes a slipping thrust washer (385) and a collar (386). The fan blades (330) are significantly larger than the conventional fan blades (430) that are with the ceiling fan unit (400).

To install the fan blade assembly (320) of the present invention on a conventional ceiling fan unit (400), the drive shaft (414) of the conventional ceiling fan (400) is extended by known methods to a distance below the conventional fan blade assembly (405). The slip clutch hub (381), the bushing (383) and the slipping thrust washer (385) are mounted on the lower end of the extended drive shaft (414) and held in place by the collar (386). The bushing (383) is directly adjacent the drive shaft (414) and is surrounded by the slip clutch hub (381). The slipping thrust washer (385) is disposed adjacent a lower end of the slip clutch hub (381).

When the conventional ceiling fan unit (400) having the fan blade assembly (320) of the present invention installed thereon is activated, the conventional fan blades (430) will rotate at designated speeds of up to 300 RPM's. However, the fan blades (330) of the present invention will rotate at a significantly lower rate of speed, due to the moment of inertia and the drag created on the larger blades (330) by the slip clutch hub (381) and the slipping thrust washer (385) during rotation. The slip clutch hub (381) will slip relative to the rotation of the drive shaft (414) supporting the fan blade assembly (305) to significantly reduce the speed of the fan blade assembly (320), while the conventional fan blades (430) rotate at the faster, designated speed of the drive shaft (414).

The relative speed of rotation of the fan blade assembly (320) of the present invention will generally be determined by the moment of inertia and aerodynamic drag combined with the amount of friction between the drive shaft (414) and the bushing (383) and the slipping thrust washer (385). For example, a seven foot diameter blade of the present invention used with a conventional ceiling fan unit may have an effective rotational speed as low as approximately 20 RPM's.

The previously described versions of the present invention have many advantages. Among such advantages are those set forth as follows.

The fan blade assembly of the present invention provides a fan blade that has a higher strength to weight ratio than conventional sized fan blades and can therefore be made larger than conventional fan blades without proportionally increasing the weight of the blades. The larger sized fan blades enable the assembly to circulate air effectively at a lower rotational velocity as compared to conventional fan blades which are required to rotate at a higher velocity to achieve the same effective air circulation. The lower rotational velocity of the fan blade assembly of the present invention significantly diminishes the noise level generated by the ceiling fan and has a lower power requirement. Additionally, by using a lower rotational velocity, the air turbulence created by the fan blades creates a more comfortable air flow movement for nearby occupants. Furthermore, the fan blades include airfoil characteristics which provide an optimal compromise for maximizing air circulation when rotating both in a clockwise and a counterclockwise direction.

Although the present invention has been described in considerable detail with reference to certain preferred versions thereof, other versions are possible. Therefore, the spirit and scope of the appended claims should not be limited to the description of the preferred versions contained herein.

What is claimed is:

1. A fan blade assembly for a ceiling fan, said fan blade assembly comprising:

a plurality of fan blades and a blade hub assembly, each of said fan blades further comprising a support frame and a covering material which covers at least a portion of said support frame;

said blade hub assembly further comprises a slip clutch hub and a hub support for retaining said fan blade assembly on a drive shaft;

wherein said plurality of said fan blades radiates outwardly from said blade hub assembly.

2. The fan blade assembly of claim 1, further comprising at least one light fixture attached to a respective one of said support frames.

3. The fan blade assembly of claim 2, further comprising a pivotal electrical hookup to transmit electrical power to said at least one light fixture.

4. The fan blade assembly of claim 3, wherein said pivotal electrical hookup further comprises a contact ring with an insulating sleeve, a brush and wire assembly and connecting wires extending between the light fixture and the contact ring.

5. The fan blade assembly of claim 1, wherein said hub support further comprises a collar and a slipping thrust washer which cooperates with the slip clutch hub to reduce rotational speed of the fan blade assembly relative to the drive shaft.

6. The fan blade assembly of claim 5, further comprising a bushing disposed on said slip clutch hub.

7. A fan blade assembly for a ceiling fan, said fan blade assembly comprising:

a plurality of fan blades and a blade hub assembly, each of said fan blades further comprising a support frame and a covering material which covers at least a portion of said support frame;

wherein said plurality of fan blades radiates outwardly from said blade hub assembly;

said support frame further comprises a plurality of longitudinal spars, a plurality of ribs and a pair of end pieces, wherein each of said ribs and each of said end pieces intersect said spars.

8. The fan blade assembly of claim 7, wherein said ribs comprise a lower member and an upper bow member.

9. The fan blade assembly of claim 8, wherein said upper bow member is prestressed and holds the lower member in tension.

10. The fan blade assembly of claim 7, wherein said pair of end pieces include a proximal end piece attached to the blade hub assembly and a distal end piece.

11. The fan blade assembly of claim 7, wherein said covering material is transparent.

12. The fan blade assembly of claim 7, wherein said portion of the support frame covered with said covering material comprises a top surface of the fan blade, with a bottom surface being uncovered.

13. The fan blade assembly of claim 7, wherein said plurality of longitudinal spars include at least one center radial spar extending through a center region of each rib and a plurality of radial edge spars, with each radial edge spar positioned adjacent to an edge of each rib.

14. The fan blade assembly of claim 13, wherein said center radial spar is adjacent to the lower member of each rib.

15. The fan blade assembly of claim 7, wherein each of said ribs further comprise an upper and lower bow and a pair of internal bridge trusses extending between the upper and lower bow.

16. The fan blade assembly of claim 15, wherein said ribs include a rib plate disposed between said pair of internal bridge trusses and extend between the upper and lower bow.

17. The fan blade assembly of claim 15, wherein said internal bridge trusses each include a pair of crossed members and a pair of side struts positioned on opposite sides of each respective pair of cross members.

18. The fan blade assembly of claim 7, wherein said ribs each comprise a rib plate having at least one aperture therein.

19. The fan blade assembly of claim 18, wherein each of said ribs further comprise a radial reinforcement plate disposed transversely to said rib plate.

20. The fan blade assembly of claim 19, wherein said radial reinforcement plate extends transversely on both sides of said rib plate.

21. The fan blade assembly of claim 7, wherein said plurality of longitudinal spars include at least one center radial spar and a plurality of radial edge spars, said spars being positioned adjacent to an edge of each rib.

22. The fan blade assembly of claim 21, wherein said plurality of longitudinal spars further comprises auxiliary spars adjacent to an edge of each said rib, said at least one center radial spar further comprising an upper and a lower center radial spar, and said plurality of radial edge spars further comprising a first edge radial spar and a second edge radial edge spar.

23. A fan blade assembly for a ceiling fan, said fan blade assembly comprising:

(1) a blade hub assembly having a central hub and a plurality of blade stems extending radially from said central hub;

(2) a plurality of fan blades, each blade attached to a respective one of said blade stems; and (3) a lighting assembly for illuminating the fan blades;

each of said fan blades further comprising a support frame and a blade covering material, wherein said support frame includes: (a) a plurality of spars including at least one center radial spar and a plurality of radial edge spars, (b) a plurality of ribs, and (c) a pair of end pieces including a proximal end piece and a distal end piece;

wherein said blade covering material covers at least a portion of the support frame;

wherein each said fan blade has a longitudinal axis, wherein the plurality of spars extend along the longitudinal axis of the fan blade from the distal end piece to the proximal end piece, the radial edge spars are disposed on opposite sides of the at least one center radial spar and spaced apart therefrom, the plurality of ribs extend transversely to the longitudinal axis of the respective fan blade at spaced distances therealong, the radial edge spars being attached to each of said ribs at an edge thereof; and wherein said lighting assembly further comprises: (a) at least one light fixture attached to the proximal end piece, (b) a pivotal electrical hookup for providing power to said at least one light fixture, said pivotal electrical hookup further comprising a contact ring, an insulating sleeve disposed adjacent the contact ring, and a plurality of connecting wires extending between the contact ring and the at least one light fixture, and (c) a brush and wire assembly for providing a positive electrical current to the contact ring, wherein said positive electrical current from the brush and wire assembly flows to the contact ring through the connecting wires to the at least one light fixture.

24. A ceiling fan comprising:

(1) a fan blade assembly which includes a central hub, a plurality of blade stems extending radially from said central hub, and a plurality of fan blades wherein each fan blade is attached to a respective one of said blade stems;

(2) a lighting assembly which includes a lighting fixture and a pivotal electrical hookup; and (3) a motorized drive unit which includes a fan motor, a drive shaft with a drive pulley and a belt extending between the fan motor and the drive pulley, wherein said central hub is attached to and rotating with said drive shaft;

said fan blades further including a support frame and a blade covering material; wherein said support frame comprises a plurality of spars having a longitudinal axis, a plurality of ribs spaced along the spars and extending generally transversely to the longitudinal axis thereof, a proximal end piece attached to one end of the spars, and a distal end piece attached to another end of the spars, said blade covering material covering at least a portion of said support frame;

wherein said at least one light fixture attached to the support frame of a respective one of said fan blades to rotate therewith.

* * * * *

UNITED STATES PATENT AND TRADEMARK OFFICE

CERTIFICATE OF CORRECTION

PATENT NO. : 6,146,097
DATED : NOVEMBER 14, 2000
INVENTOR(S) : Gordon E. Bradt

It is certified that error appears in the above-identified patent and that said Letters Patent is hereby corrected as shown below:

At column 7, line 27, "305" should read 320.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*